US011043202B2

(12) United States Patent
Tachi et al.

(10) Patent No.: US 11,043,202 B2
(45) Date of Patent: Jun. 22, 2021

(54) ACTIVE NOISE CONTROL SYSTEM, SETTING METHOD OF ACTIVE NOISE CONTROL SYSTEM, AND AUDIO SYSTEM

(71) Applicant: ALPINE ELECTRONICS, INC., Tokyo (JP)

(72) Inventors: Ryosuke Tachi, Fukushima (JP); Yoshinobu Kajikawa, Osaka (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 16/724,846

(22) Filed: Dec. 23, 2019

(65) Prior Publication Data

US 2020/0211526 A1 Jul. 2, 2020

(30) Foreign Application Priority Data

Dec. 26, 2018 (JP) ..... JP2018-243647

(51) Int. Cl.
*G10K 11/178* (2006.01)

(52) U.S. Cl.
CPC .. *G10K 11/17854* (2018.01); *G10K 11/17881* (2018.01); *G10K 2210/1282* (2013.01); *G10K 2210/3026* (2013.01); *G10K 2210/3027* (2013.01); *G10K 2210/3028* (2013.01); *G10K 2210/3046* (2013.01)

(58) Field of Classification Search
CPC ... G10K 2210/3221; G10K 2210/3026; G10K 2210/3027; G10K 2210/3028
See application file for complete search history.

(56) References Cited

U.S. PATENT DOCUMENTS 5,216,722 A * 6/1993 Popovich ..... G10K 11/17854 381/71.11
2005/0053244 A1* 3/2005 Onishi ..... G10K 11/17823 381/71.11

(Continued)

FOREIGN PATENT DOCUMENTS

JP 2018-072770 A 5/2018

OTHER PUBLICATIONS

Kuo et al., "Active Noise Control: A Tutorial Review", Proceeding of the IEEE, IEEE. New York, US, vol. 87, No. 6, Jun. 1, 1999, pp. 943-973.

*Primary Examiner* — James K Mooney
(74) *Attorney, Agent, or Firm* — Brinks Gilson & Lione

(57) ABSTRACT

Two subsystems, each including a microphone, a speaker, a canceling sound-generating adder, an error-computing adder, and two adaptive filters and two auxiliary filters that accept two noises as input, are provided in correspondence with two cancellation positions. Each canceling sound-generating adder adds together the outputs from the adaptive filters and outputs the result to the speaker of each subsystem. Each error-computing adder adds together the output from the microphone of the subsystem and the output from the auxiliary filter of the subsystem, and the result is treated as the error of the adaptive filters of each subsystem. A transfer function is learned in advance and set in each auxiliary filter such that each error computed by each error-computing adder becomes zero (0) when a transfer function in which each noise is canceled at each cancellation position in a predetermined standard acoustic environment is set in each adaptive filter.

4 Claims, 6 Drawing Sheets

(56) References Cited

U.S. PATENT DOCUMENTS

| | | | | |
|---|---|---|---|---|
| 2009/0097669 | A1 | 4/2009 | Kamiya | |
| 2010/0014685 | A1* | 1/2010 | Wurm | G10K 11/178<br>381/71.11 |

* cited by examiner

ACTIVE NOISE CONTROL SYSTEM, SETTING METHOD OF ACTIVE NOISE CONTROL SYSTEM, AND AUDIO SYSTEM

RELATED APPLICATIONS

The present application claims priority to Japanese Patent Appln. No. 2018-243647, filed Dec. 26, 2018, the entire disclosure of which is hereby incorporated by reference.

BACKGROUND OF THE DISCLOSURE

Field of the Disclosure

The present disclosure relates to active noise control (ANC) technology that reduces noise by emitting noise-canceling sound to cancel out noise.

Description of the Related Art

One known technology for active noise control that reduces noise by emitting noise-canceling sound to cancel out noise is provided with a microphone disposed near a noise cancellation position, a speaker disposed near the noise cancellation position, and an adaptive filter that performs a transfer function set to a noise signal that expresses noise and generates noise-canceling sound to be output from the speaker. In the adaptive filter, the transfer function is set adaptively by using a signal obtained by correcting the output of the microphone using an auxiliary filter as an error signal (for example, JP 2018-72770 A).

With this technology, a transfer function learned in advance that corrects a difference between the transfer function from the noise source to the noise cancellation position and the transfer function from the noise source to the output of the microphone, and a difference between the transfer function from the speaker to the noise cancellation position and the transfer function from the speaker to the output of the microphone, is set in the auxiliary filter. By using such an auxiliary filter, it is possible to cancel noise at a noise cancellation position that is different from a position of the microphone.

Another known technology is provided with sets of a microphone, a speaker, an adaptive filter, and an auxiliary filter corresponding to each of a plurality of noise cancellation positions. By using the technology described above to output noise-canceling sound that cancels noise at the corresponding noise cancellation position in each set, noise is canceled at each of the plurality of noise cancellation positions (JP 2018-72770 A).

The technologies described above anticipate only the case of a single noise source. In cases where a plurality of noise sources exists, the noise from each noise source cannot be canceled appropriately at each noise cancellation position.

SUMMARY

The present disclosure deals with a case where a plurality of noise sources exists, and addresses the issue of canceling noise from each noise source appropriately at each of a plurality of noise cancellation positions.

In order to address the issues described above, the present disclosure provides an active noise control system that reduces noise. In one form, an active noise control system includes: n (where n≥2) subsystems respectively provided in correspondence with each of n noise cancellation positions, wherein each subsystem includes a microphone and a speaker disposed near the corresponding noise cancellation position, a canceling sound-generating adder, an error-computing adder, m (where m≥2) adaptive filters, respectively provided in correspondence with each of m noises, that accept the corresponding noise as input, and m auxiliary filters, respectively provided in correspondence with each of the m noises, that accept the corresponding noise as input. Here, the canceling sound-generating adder of each subsystem adds together outputs from the m adaptive filters of the subsystem, and outputs a result to the speaker of the subsystem, the error-computing adder of each subsystem adds together and outputs an output from the microphone of the subsystem and outputs from the m auxiliary filters of the subsystem, and an adaptive filter of each subsystem updates a transfer function of the adaptive filter by executing a predetermined adaptive algorithm that treats the output from the error-computing adder of each subsystem as an error. Then, a transfer function is set in each auxiliary filter such that each error computed by the error-computing adder of each subsystem becomes zero (0) when a transfer function in which each noise is canceled at each cancellation position in a predetermined standard acoustic environment is set in each adaptive filter.

Further, in order to address the issues described above, the present disclosure provides an active noise control system that reduces noise, including: two subsystems respectively provided in correspondence with each of two noise cancellation positions, wherein each subsystem includes a microphone and a speaker disposed near the noise corresponding cancellation position, a canceling sound-generating adder, an error-computing adder, two adaptive filters, respectively provided in correspondence with each of two noises, that accept the corresponding noise as input, and two auxiliary filters, respectively provided in correspondence with each of the two noises, that accept the corresponding noise as input. Here, the canceling sound-generating adder of each subsystem adds together outputs from the two adaptive filters of the subsystem, and outputs a result to the speaker of the subsystem, the error-computing adder of each subsystem adds together and outputs an output from the microphone of the subsystem and outputs from the two auxiliary filters of the subsystem, and an adaptive filter of each subsystem updates a transfer function of the adaptive filter by executing a predetermined adaptive algorithm that treats the output from the error-computing adder of each subsystem as an error. Provided that $P_{jk}$ is the transfer function of the jth noise to the output from the microphone of the kth subsystem, $S_{Pjk}$ is the transfer function from the speaker of the jth subsystem to the output from the microphone of the kth subsystem, $V_{jk}$ is the transfer function of the jth noise to the kth cancellation position, $S_{Vjk}$ is the transfer function from the speaker of the jth subsystem to the kth cancellation position, and $H_{jk}$ is the transfer function of the auxiliary filter corresponding to the jth noise of the kth subsystem, $$H_{11}(z)=-[P_{11}(z)+\{V_{12}(z)S_{V21}(z)-V_{11}(z)S_{V22}(z)\}S_{P11}(z)+\{V_{11}(z)S_{V12}(z)-V_{12}(z)S_{V11}(z)\}S_{P21}(z)]/[S_{V11}(z)S_{V22}(z)-S_{V12}(z)S_{V21}(z)]$$

$$H_{12}(z)=-[P_{12}(z)+\{V_{12}(z)S_{V21}(z)-V_{11}(z)S_{V22}(z)\}S_{P12}(z)+\{V_{11}(z)S_{V12}(z)-V_{12}(z)S_{V11}(z)\}S_{P22}(z)]/[S_{V11}(z)S_{V22}(z)-S_{V12}(z)S_{V21}(z)]$$

$$H_{21}(z)=-[P_{21}(x)+\{V_{22}(z)S_{V21}(z)-V_{21}(z)S_{V22}(z)\}S_{P11}(z)+\{V_{21}(z)S_{V12}(z)-V_{22}(z)S_{V11}(z)\}S_{P21}(z)]/[S_{V11}(z)S_{V22}(z)-S_{V12}(z)S_{V21}(z)]$$

$$H_{22}(z)=-[P_{22}(x)+\{V_{22}(z)S_{V21}(z)-V_{21}(z)S_{V22}(z)\}S_{P12}(z)+\{V_{21}(z)S_{V12}(z)-V_{22}(z)S_{V11}(z)\}S_{P22}(z)]/[S_{V11}(z)S_{V22}(z)-S_{V12}(z)S_{V21}(z)].$$

Further, in order to achieve the issues described above, the present disclosure provides a setting method of an active noise control system that reduces noise. Here, the active noise control system includes two subsystems respectively provided in correspondence with each of two noise cancellation positions, in which each subsystem includes a microphone and a speaker disposed near the corresponding noise cancellation position, a canceling sound-generating adder, an error-computing adder, two adaptive filters, respectively provided in correspondence with each of two noises, that accept the corresponding noise as input, and two auxiliary filters, respectively provided in correspondence with each of the two noises, that accept the corresponding noise as input. Further, the canceling sound-generating adder of each subsystem adds together outputs from the two adaptive filters of the subsystem, and outputs a result to the speaker of the subsystem, the error-computing adder of each subsystem adds together and outputs an output from the microphone of the subsystem and outputs from the two auxiliary filters of the subsystem, and an adaptive filter of each subsystem updates a transfer function of the adaptive filter by executing a predetermined adaptive algorithm that treats the output from the error-computing adder of each subsystem as an error.

One form of a setting method is a method of setting the transfer function of each auxiliary filter, including: executing a first step of learning the transfer function of each adaptive filter that converges in a configuration obtained by respectively disposing two setting microphones at each of two noise cancellation positions, and changing a configuration of the active noise control system such that each adaptive filter executes a predetermined adaptive algorithm treating an output from each setting microphone as error to update the transfer function of the adaptive filter, and executing a second step of learning the transfer function of each adaptive filter replacing each auxiliary filter as the transfer function to set in the auxiliary filter replaced by the adaptive filter that converges in a configuration of the active noise control system obtained by fixing the transfer function of each adaptive filter to the transfer function learned in the first step and replacing each auxiliary filter with an adaptive filter that treats the output from the error-computing adder of the same subsystem as the subsystem of the auxiliary filter as error to execute a predetermined adaptive algorithm and update the transfer function of the adaptive filter.

According to forms of the active noise control system and the setting method of the active noise control system as above, a transfer function is set in each auxiliary filter such that each error computed by the error-computing adder in each subsystem becomes zero (0) when a transfer function in which each noise is canceled at each cancellation position in a predetermined standard acoustic environment is set in each adaptive filter. Consequently, even in the case where a plurality of noises exists, in the standard state, noise from each noise source may be canceled appropriately at each of the plurality of noise cancellation positions, while in addition, even in the case where a variation from the standard acoustic environment occurs in the acoustic environment, each noise may be canceled appropriately at each of the plurality of noise cancellation positions by the adaptive operation of the adaptive filters.

Here, the present disclosure also provides an audio system onboard an automobile provided with the active noise control system described above, including: an audio device for a user seated in a first seat of the automobile, that emits audio inside the automobile. Here, in this audio system, the two noises may be left-channel audio and right-channel audio emitted by the audio device, and the two noise cancellation positions may be a position of a left ear and a position of a right ear of a user seated in a second seat of the automobile.

As above, according to the present disclosure, even in the case where a plurality of noise sources exists, it is possible to cancel noise from each noise source appropriately at each of a plurality of noise cancellation positions.

DESCRIPTION OF THE DRAWINGS

Figure 1:
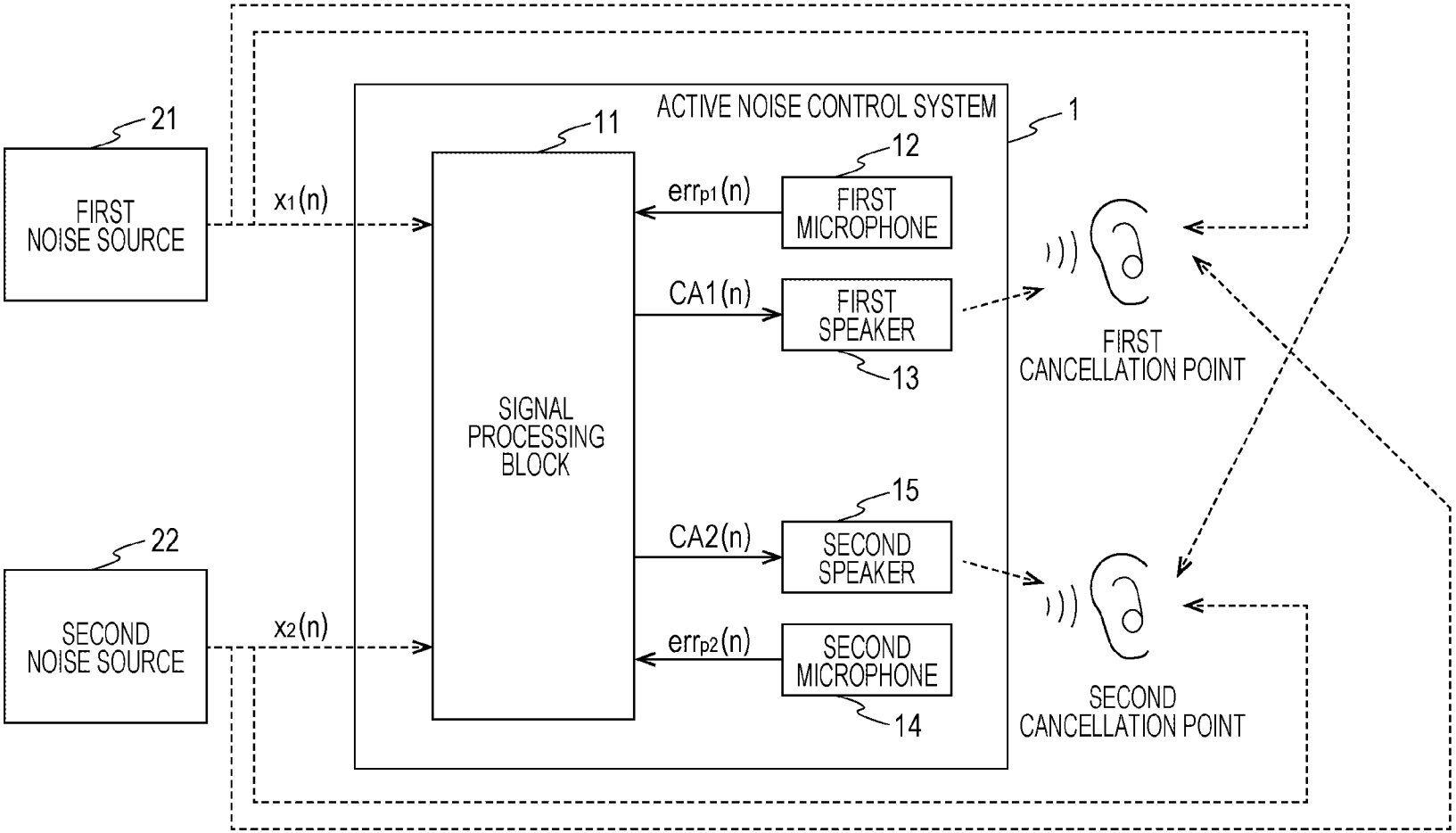
FIG. 1 is a block diagram illustrating one form of a configuration of an active noise control system.

FIG. 1 illustrates one form of a configuration of the active noise control system.

As illustrated in the diagram, an active noise control system 1 is provided with a signal processing block 11, a first microphone 12, a first speaker 13, a second microphone 14, and a second speaker 15.

The active noise control system 1 is a system that cancels noise produced by a first noise source 21 and noise produced by a second noise source 22 at each of two points, namely a first cancellation point and a second cancellation point.

The first microphone 12 and the first speaker 13 are disposed near the first cancellation point, while the second microphone 14 and the second speaker 15 are disposed near the second cancellation point.

Additionally, the signal processing block 11 uses a first noise signal $x_1(n)$ expressing noise produced by the first noise source 21, a second noise signal $x_2(n)$ expressing noise produced by the second noise source 22, a first microphone error signal $err_{p1}(n)$, which is a sound signal picked up by the first microphone 12, and a second microphone error signal $err_{p2}(n)$, which is a sound signal picked up by the second microphone 14, to generate and output from the first speaker 13 a first canceling signal CA1(n) that cancels the noise produced by the first noise source 21 and the noise produced by the second noise source 22 at the first cancellation point, and to generate and output from the second speaker 15 a second canceling signal CA2(n) that cancels the noise produced by the first noise source 21 and the noise produced by the second noise source 22 at the second cancellation point.

Herein, such an active noise control system 1 may be applied to an audio system installed in an automobile, for example.

Figure 2A:
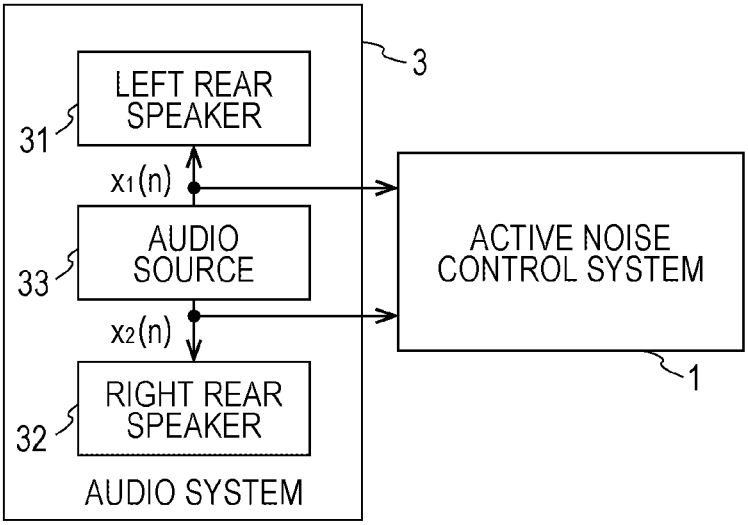
FIGS. 2A, 2B, and 2C are diagrams illustrating an application example of the active noise control system.

In other words, for example, as illustrated in FIG. 2A, for an in-vehicle audio system 3 provided with a left rear speaker 31 disposed on the left side of the rear seats of an automobile, a right rear speaker 32 disposed on the right side of the rear seats of the automobile, and an audio source 33 that outputs audio content for users in the rear seats from the left rear speaker 31 and the right rear speaker 32, the active noise control system 1 may applied by treating a left-channel audio signal output to the left rear speaker 31 by the audio source 33 as the first noise signal $x_1(n)$, treating a right-channel audio signal output to the right rear speaker 32 by the audio source 33 as the second noise signal $x_2(n)$, treating the position of the left ear of the user sitting in the driver's seat as the first cancellation point, and treating the position of the right ear of the user sitting in the driver's seat as the second cancellation point. In this way, the sound of the audio content for users in the rear seats output by the audio system 3 may be canceled for the user sitting in the driver's seat.

Note that in this case, the audio source 33 corresponds to the first noise source 21 and the second noise source 22.

Figure 2B:
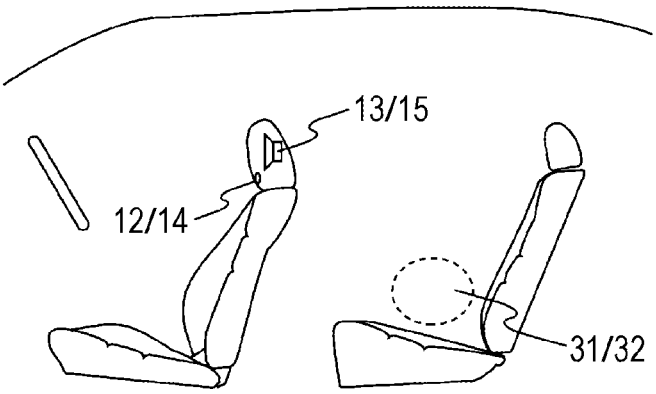
Figure 2C:
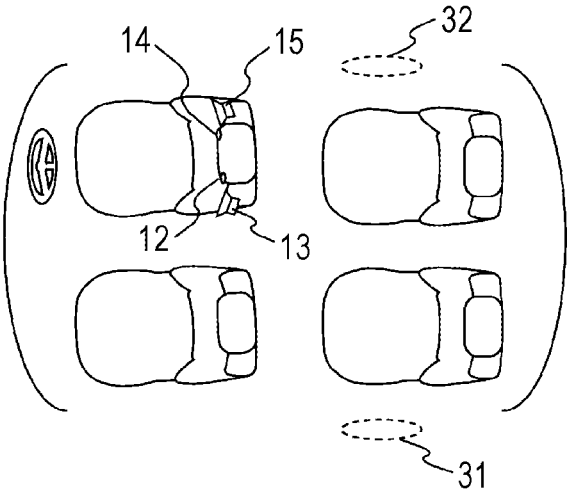

Also, in this case, as illustrated in FIGS. 2B and 2C, the first microphone 12 and the first speaker 13 are disposed at positions in the headrest of the driver's seat near the position of the left ear of the user sitting in the driver's seat, while the second microphone 14 and the second speaker 15 are disposed at positions in the headrest of the driver's seat near the position of the right ear of the user sitting in the driver's seat.

Figure 3:
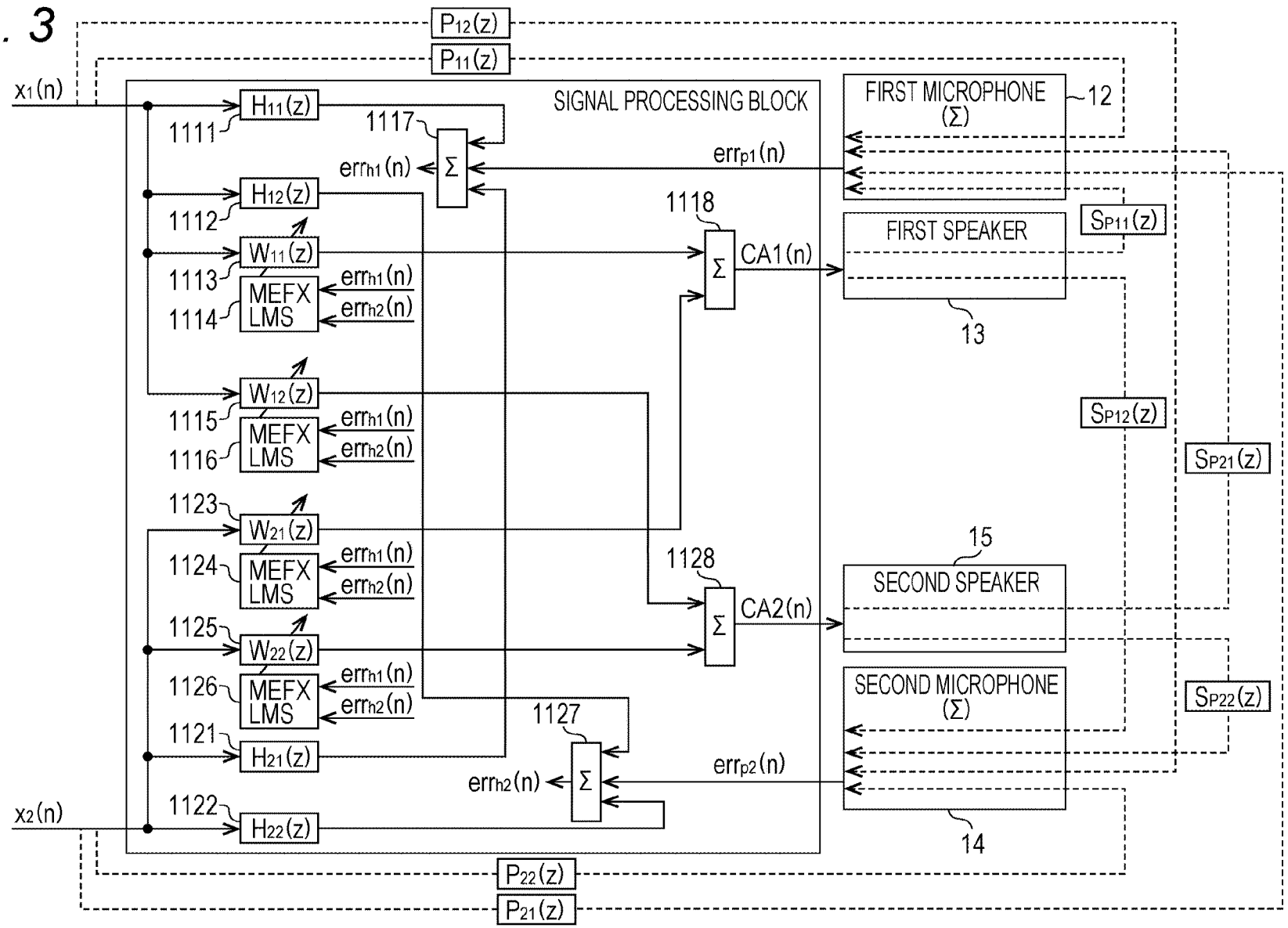
FIG. 3 is a block diagram illustrating one form of a configuration of a signal processing block.

Next, FIG. 3 illustrates a configuration of the signal processing block 11 of the active noise control system 1.

Note that the active noise control system 1 is divided into Sections 1 and 2, in which Section 1 is a subsystem that mainly performs processing related to the first cancellation point and Section 2 is a subsystem that mainly performs processing related to the second cancellation point. The first microphone 12, the first speaker 13, and regions of the signal processing block 11 labeled "Section 1" hereinafter form Section 1, while the second microphone 14, the second speaker 15, and regions of the signal processing block 11 labeled "Section 2" hereinafter form Section 2.

Additionally, as illustrated in the diagram, the signal processing block 11 is provided with a Section 1 first auxiliary filter 1111 in which a transfer function $H_{11}(z)$ is preset, a Section 2 first auxiliary filter 1112 in which a transfer function $H_{12}(z)$ is preset, a Section 1 first variable filter 1113, a Section 1 first adaptive algorithm execution unit 1114, a Section 2 first variable filter 1115, a Section 2 first adaptive algorithm execution unit 1116, a Section 1 error-correcting adder 1117, and a Section 1 canceling sound-generating adder 1118.

The Section 1 first variable filter 1113 and the Section 1 first adaptive algorithm execution unit 1114 form an adaptive filter, in which the Section 1 first adaptive algorithm execution unit 1114 updates a transfer function $W_{11}(z)$ of the Section 1 first variable filter 1113 according to a multiple error filtered X least mean squares (MEFX LMS) algorithm. Also, the Section 2 first variable filter 1115 and the Section 2 first adaptive algorithm execution unit 1116 form an adaptive filter, in which the Section 2 first adaptive algorithm execution unit 1116 updates a transfer function $W_{12}(z)$ of the Section 2 first variable filter 1115 according to a MEFX LMS algorithm.

In addition, the signal processing block 11 is provided with a Section 1 second auxiliary filter 1121 in which a transfer function $H_{21}(z)$ is preset, a Section 2 second auxiliary filter 1122 in which a transfer function $H_{22}(z)$ is preset, a Section 1 second variable filter 1123, a Section 1 second adaptive algorithm execution unit 1124, a Section 2 second variable filter 1125, a Section 2 second adaptive algorithm execution unit 1126, a Section 2 error-correcting adder 1127, and a Section 2 canceling sound-generating adder 1128.

Then, the Section 1 second variable filter 1123 and the Section 1 second adaptive algorithm execution unit 1124 form an adaptive filter, in which the Section 1 second adaptive algorithm execution unit 1124 updates a transfer function $W_{21}(z)$ of the Section 1 second variable filter 1123 according to a MEFX LMS algorithm. Also, the Section 2 second variable filter 1125 and the Section 2 second adaptive algorithm execution unit 1126 form an adaptive filter, in which the Section 2 second adaptive algorithm execution unit 1126 updates a transfer function $W_{22}(z)$ of the Section 2 second variable filter 1125 according to a MEFX LMS algorithm.

In such a configuration, the first noise signal $x_1(n)$ input into the active noise control system 1 is sent to the Section 1 first auxiliary filter 1111, the Section 2 first auxiliary filter 1112, the Section 1 first variable filter 1113, and the Section 2 first variable filter 1115.

Also, the first microphone error signal $err_{p1}(n)$ input from the first microphone 12 is sent to the Section 1 error-correcting adder 1117, while the second microphone error signal $err_{p2}(n)$ is sent to the Section 2 error-correcting adder 1127.

Additionally, the output of the Section 1 first auxiliary filter 1111 is sent to the Section 1 error-correcting adder 1117, the output of the Section 2 first auxiliary filter 1112 is sent to the Section 2 error-correcting adder 1127, the output of the Section 1 first variable filter 1113 is sent to the Section 1 canceling sound-generating adder 1118, and the output of the Section 2 first variable filter 1115 is sent to the Section 2 canceling sound-generating adder 1128.

In addition, the first noise signal $x_1(n)$ input into the active noise control system 1 is sent to the Section 1 second auxiliary filter 1121, the Section 2 second auxiliary filter 1122, the Section 1 second variable filter 1123, and the Section 2 second variable filter 1125.

Additionally, the output of the Section 1 second auxiliary filter 1121 is sent to the Section 1 error-correcting adder 1117, the output of the Section 2 second auxiliary filter 1122 is sent to the Section 2 error-correcting adder 1127, the output of the Section 1 second variable filter 1123 is sent to the Section 1 canceling sound-generating adder 1118, and the output of the Section 2 second variable filter 1125 is sent to the Section 2 canceling sound-generating adder 1128.

The Section 1 error-correcting adder 1117 adds together the output of the Section 1 first auxiliary filter 1111, the output of the Section 1 second auxiliary filter 1121, and the first microphone error signal $err_{p1}(n)$ to generate a first error signal $err_{h1}(n)$, while the Section 2 error-correcting adder 1127 adds together the output of the Section 2 first auxiliary filter 1112, the output of the Section 2 second auxiliary filter 1122, and the second microphone error signal $err_{p2}(n)$ to generate a second error signal $err_{h2}(n)$. Subsequently, the first error signal $err_{h1}(n)$ and the second error signal $err_{h2}(n)$ are output as multi-error to the Section 1 first adaptive algorithm execution unit 1114, the Section 2 first adaptive algorithm execution unit 1116, the Section 1 second adaptive algorithm execution unit 1124, and the Section 2 second adaptive algorithm execution unit 1126.

Also, the Section 1 canceling sound-generating adder 1118 adds together the output of the Section 1 first variable filter 1113 and the output of the Section 1 second variable filter 1123 to generate the first canceling signal CA1(n) to be output from the first speaker 13, while the Section 2 canceling sound-generating adder 1128 adds together the output of the Section 2 first variable filter 1115 and the Section 2 second variable filter 1125 to generate the second canceling signal CA2(n) to be output from the second speaker 15.

Additionally, the Section 1 first adaptive algorithm execution unit 1114 updates the transfer function $W_{11}(z)$ of the Section 1 first variable filter 1113 according to a MEFX LMS algorithm such that the first error signal $err_{h1}(n)$ and the second error signal $err_{h2}(n)$ input as the multi-error become 0. The Section 2 first adaptive algorithm execution unit 1116 updates the transfer function $W_{12}(z)$ of the Section 2 first variable filter 1115 according to a MEFX LMS algorithm such that the first error signal $err_{h1}(n)$ and the second error signal $err_{h2}(n)$ input as the multi-error become 0. The Section 1 second adaptive algorithm execution unit 1124 updates the transfer function $W_{21}(z)$ of the Section 1 second variable filter 1123 according to a MEFX LMS algorithm such that the first error signal $err_{h1}(n)$ and the second error signal $err_{h2}(n)$ input as the multi-error become 0. The Section 2 second adaptive algorithm execution unit 1126 updates the transfer function $W_{22}(z)$ of the Section 2 second variable filter 1125 according to a MEFX LMS algorithm such that the first error signal $err_{h1}(n)$ and the second error signal $err_{h2}(n)$ input as the multi-error become 0.

Next, in the active noise control system 1 as above, the transfer function $H_{11}(z)$ of the Section 1 first auxiliary filter 1111, the transfer function $H_{12}(z)$ of the Section 2 first auxiliary filter 1112, the transfer function $H_{21}(z)$ of the Section 1 second auxiliary filter 1121, and the transfer function $H_{22}(z)$ of the Section 2 second auxiliary filter 1122 of the signal processing block 11 are preset by a learning process indicated below.

The learning process is performed in a standard acoustic environment, which is a normal acoustic environment to which the active noise control system 1 is applied.

Also, the learning process includes a first-stage learning process and a second-stage learning process.

Figure 4:
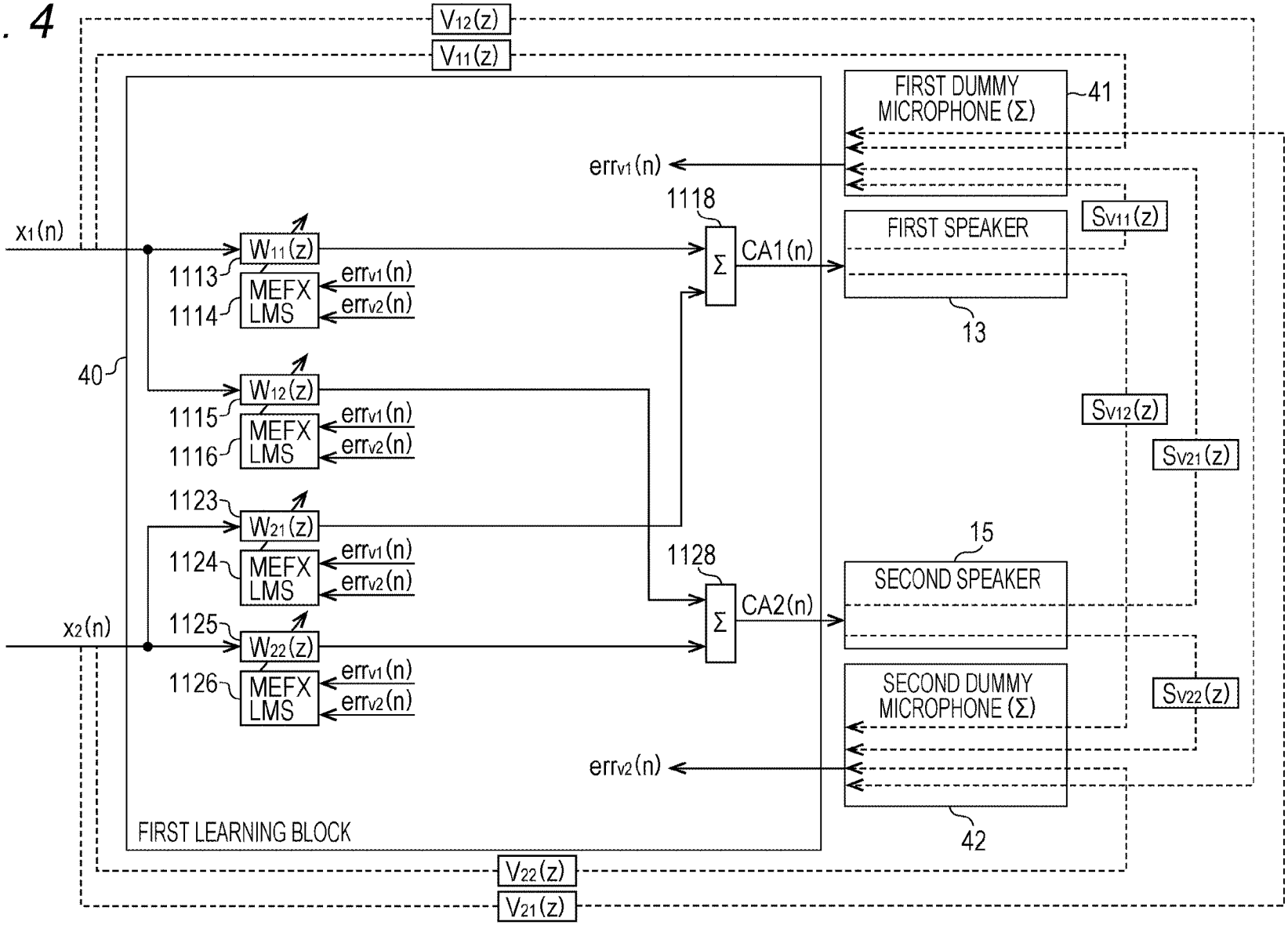
FIG. 4 is a block diagram illustrating one form of a configuration of a first learning block.

As illustrated in FIG. 4, the first-stage learning process is performed in a configuration in which the signal processing block 11 of the active noise control system 1 has been replaced with a first learning block 40. Herein, as illustrated in FIG. 4, the first learning block 40 is provided with a configuration in which the Section 1 first auxiliary filter 1111, the Section 2 first auxiliary filter 1112, the Section 1 second auxiliary filter 1121, the Section 2 second auxiliary filter 1122, the Section 1 error-correcting adder 1117, and the Section 2 error-correcting adder 1127 have been removed from the signal processing block 11 illustrated in FIG. 3.

Also, the first-stage learning process is performed by connecting a first dummy microphone 41 disposed at the first cancellation point and a second dummy microphone 42 disposed at the second cancellation point to a first learning block 40.

Also, in the first learning block 40, a sound signal $err_{v1}(n)$ output by the first dummy microphone 41 and a sound signal $err_{v2}(n)$ output by the second dummy microphone 42 are configured to be used as the multi-error of the Section 1 first adaptive algorithm execution unit 1114, the Section 2 first adaptive algorithm execution unit 1116, the Section 1 second adaptive algorithm execution unit 1124, and the Section 2 second adaptive algorithm execution unit 1126.

Note that in such a first learning block 40, the Section 1 first adaptive algorithm execution unit 1114 updates the transfer function $W_{11}(z)$ of the Section 1 first variable filter 1113 according to a MEFX LMS algorithm such that $err_{v1}(n)$ and $err_{v2}(n)$ input as the multi-error become 0. The Section 2 first adaptive algorithm execution unit 1116 updates the transfer function $W_{12}(z)$ of the Section 2 first variable filter 1115 according to a MEFX LMS algorithm such that $err_{v1}(n)$ and $err_{v2}(n)$ input as the multi-error become 0. The Section 1 second adaptive algorithm execution unit 1124 updates the transfer function $W_{12}(z)$ of the Section 1 second variable filter 1123 according to a MEFX LMS algorithm such that $err_{v1}(n)$ and $err_{v2}(n)$ input as the multi-error become 0. The Section 2 second adaptive algorithm execution unit 1126 updates the transfer function $W_{22}(z)$ of the Section 2 second variable filter 1125 according to a MEFX LMS algorithm such that $err_{v1}(n)$ and $err_{v2}(n)$ input as the multi-error become 0.

Figure 5A:
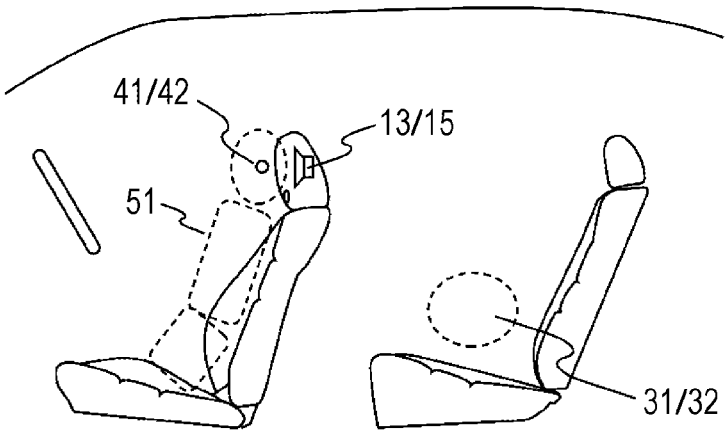
FIGS. 5A and 5B are diagrams illustrating an example of the placement of a dummy microphone.
Figure 5B:
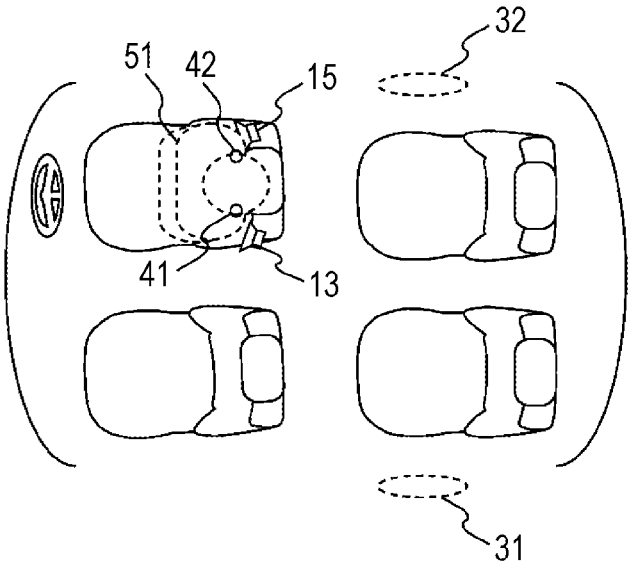

Herein, in the case of applying the active noise control system 1 to the in-vehicle audio system 3 as illustrated in FIGS. 2A to 2C, the placement of the first dummy microphone 41 at the first cancellation point and the placement of the second dummy microphone 42 at the second cancellation point are achieved by, for example, disposing the first dummy microphone 41 at the position of the left ear of a dummy figure 51 seated in the driver's seat and disposing the second dummy microphone 42 at the position of the right ear of the dummy figure 51 seated in the driver's seat, as illustrated in FIGS. 5A and 5B.

Next, in the first-stage learning process using such a first learning block 40, the first noise signal $x_1(n)$ and the second noise signal $x_2(n)$ are input into the first learning block 40, and if the transfer function $W_{11}(z)$ of the Section 1 first variable filter 1113, the transfer function $W_{12}(z)$ of the Section 2 first variable filter 1115, the transfer function $W_{21}(z)$ of the Section 1 second variable filter 1123, and the transfer function $W_{22}(z)$ of the Section 2 second variable filter 1125 have convergence and converge, each of the transfer functions $W_{11}(z)$, $W_{12}(z)$, $W_{21}(z)$, and $W_{22}(z)$ is acquired.

Herein, as illustrated in FIG. 4, provided that $V_{11}(z)$ is a transfer function of the first noise signal $x_1(n)$ to the output of the first dummy microphone 41, $V_{12}(z)$ is a transfer function of the first noise signal $x_1(n)$ to the output of the second dummy microphone 42, $V_{21}(z)$ is a transfer function of the second noise signal $x_2(n)$ to the output of the first dummy microphone 41, $V_{22}(z)$ is a transfer function of the second noise signal $x_2(n)$ to the output of the second dummy microphone 42, $S_{V11}(z)$ is a transfer function of the first canceling signal CA1(n) to the output of the first dummy microphone 41, $S_{V12}(z)$ is a transfer function of the first canceling signal CA1(n) to the output of the second dummy microphone 42, $S_{V21}(z)$ is a transfer function of the second canceling signal CA2(n) to the output of the first dummy microphone 41, $S_{V22}(z)$ is a transfer function of the second canceling signal CA2(n) to the output of the second dummy microphone 42, $x_i(z)$ is the Z-transform of $x_i(n)$, and $err_{vi}(z)$ is the Z-transform of $err_{vi}(n)$, $err_{v1}(z)$ output by the first dummy microphone 41 becomes $$\begin{aligned} err_{v1}(z) &= x_1(z)V_{11}(z) + \{x_1(z)W_{11}(z) + x_2(z)W_{21}(z)\}S_{V11}(z) + \\ &\{x_1(z)W_{12}(z) + x_2(z)W_{22}(z)\}S_{V21}(z) + x_2(z)V_{21}(x) = \\ &x_1(z)\{V_{11}(z) + W_{11}(z)S_{V11}(z) + W_{12}(z)S_{V21}(z)\} + \\ &x_2(z)\{V_{21}(x) + W_{21}(x)S_{V11}(z) + W_{22}(z)S_{V21}(z)\}, \end{aligned}$$

and $err_{v2}(z)$ output by the second dummy microphone 42 similarly becomes $$\begin{aligned} err_{v2}(z) = x_1(z)\{V_{12}(z)+W_{11}(z)S_{V12}(z)+W_{12}(z)S_{V22}(z)\}+ \\ x_2(z)\{V_{22}(x)+W_{21}(x)S_{V12}(z)+W_{22}(z)S_{V22}(z)\}. \end{aligned}$$

Because $x_1(z) \neq 0$ and $x_2(z) \neq 0$, $err_{v1}(z)=0$ and $err_{v2}(z)=0$ hold when $$\{V_{11}(z)+W_{11}(z)S_{V11}(z)+W_{12}(z)S_{V21}(z)\}=0$$

$$\{V_{21}(x)+W_{21}(x)S_{V11}(z)+W_{22}(z)S_{V21}(z)\}=0$$

$$\{V_{12}(z)+W_{11}(z)S_{V12}(z)+W_{12}(z)S_{V22}(z)\}=0$$

$$\{V_{22}(x)+W_{21}(x)S_{V12}(z)+W_{22}(z)S_{V22}(z)\}=0,$$

solving the system of simultaneous equations for $W_{11}$, $W_{12}$, $W_{21}$, and $W_{22}$ gives $$W_{11}=\{V_{12}(z)S_{V21}(z)-V_{11}(z)S_{V22}(z)\}/\{S_{V11}(z)S_{V22}(z)-S_{V12}(z)S_{V21}(z)\}$$

$$W_{12}=\{V_{11}(z)S_{V12}(z)-V_{12}(z)S_{V11}(z)\}/\{S_{V11}(z)S_{V22}(z)-S_{V12}(z)S_{V21}(z)\}$$

$$W_{21}=\{V_{22}(z)S_{V21}(z)-V_{21}(z)S_{V22}(z)\}/\{S_{V11}(z)S_{V22}(z)-S_{V12}(z)S_{V21}(z)\}$$

$$W_{22}=\{V_{21}(z)S_{V12}(z)-V_{22}(z)S_{V11}(z)\}/\{S_{V11}(z)S_{V22}(z)-S_{V12}(z)S_{V21}(z)\}.$$

In the first learning block 40, the transfer functions $W_{11}(z)$, $W_{12}(z)$, $W_{21}(z)$, and $W_{22}(z)$ converge on these values.

Also, the values of the converged transfer functions $W_{11}$, $W_{12}$, $W_{21}$, and $W_{22}$ cancel the noise produced by the first noise source 21 and the noise produced by the second noise source 22 at the first cancellation point and the second cancellation point.

Next, if such transfer functions $W_{11}(z)$, $W_{12}(z)$, $W_{21}(z)$, and $W_{22}(z)$ converged by the first-stage learning process using the first learning block 40 are acquired, the first-stage learning process ends, and a second-stage learning process is performed.

Figure 6:
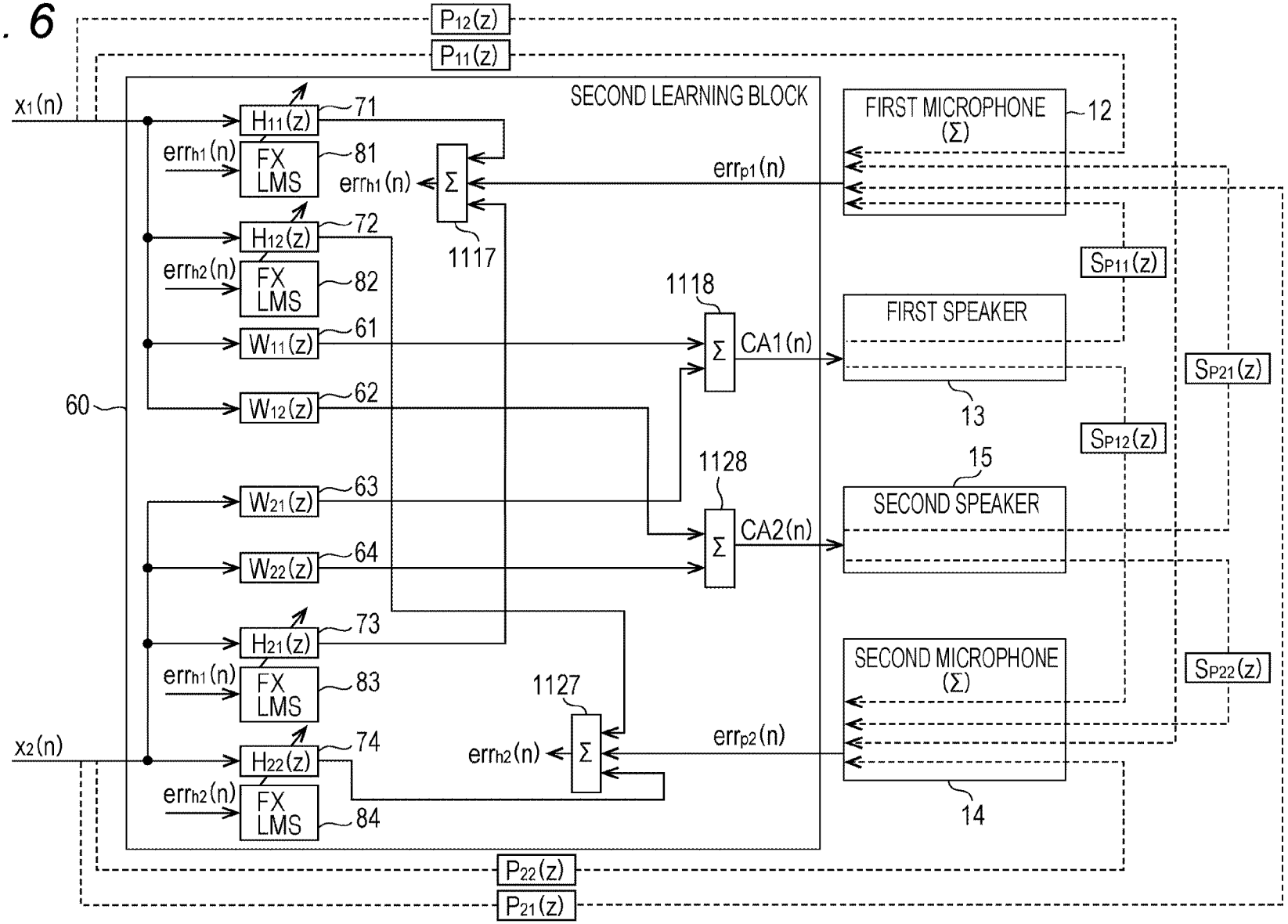
FIG. 6 is a block diagram illustrating one form of a configuration of a second learning block.

As illustrated in FIG. 6, the second-stage learning process is performed in a configuration in which the signal processing block 11 of the active noise control system 1 has been replaced with a second learning block 60. Herein, as illustrated in FIG. 6, the second learning block 60 is provided with a configuration obtained by omitting the Section 1 first adaptive algorithm execution unit 1114, the Section 2 first adaptive algorithm execution unit 1116, the Section 1 second adaptive algorithm execution unit 1124, and the Section 2 second adaptive algorithm execution unit 1126 from the signal processing block 11 illustrated in FIG. 3, replacing the Section 1 first variable filter 1113 with a Section 1 first fixed filter 61 in which the transfer function is fixed to the transfer function $W_{11}(z)$ acquired by the first learning process, replacing the Section 2 first variable filter 1115 with a Section 2 first fixed filter 62 in which the transfer function is fixed to the transfer function $W_{12}(z)$ acquired by the first learning process, replacing the Section 1 second variable filter 1123 with a Section 1 second fixed filter 63 in which the transfer function is fixed to the transfer function $W_{21}(z)$ acquired by the first learning process, and replacing the Section 2 second variable filter 1125 with a Section 2 second fixed filter which the transfer function is fixed to the transfer function $W_{22}(z)$ acquired by the first learning process.

Also, as illustrated in FIG. 6, the second learning block 60 is provided with a configuration in which, in the signal processing block 11 illustrated in FIG. 3, the Section 1 first auxiliary filter 1111 has been replaced by a Section 1 first variable auxiliary filter 71 and a Section 1 learning first adaptive algorithm execution unit 81 that updates the transfer function $H_{11}(z)$ of the Section 1 first variable auxiliary filter 71 according to an FXLMS algorithm has been provided, the Section 2 first auxiliary filter 1112 has been replaced by a Section 2 first variable auxiliary filter 72 and a Section 2 learning first adaptive algorithm execution unit 82 that updates the transfer function $H_{12}(z)$ of the Section 2 first variable auxiliary filter 72 according to an FXLMS algorithm has been provided, the Section 1 second auxiliary filter 1121 has been replaced by a Section 1 second variable auxiliary filter 73 and a Section 1 learning second adaptive algorithm execution unit 83 that updates the transfer function $H_{21}(z)$ of the Section 1 second variable auxiliary filter 73 according to an FXLMS algorithm has been provided, and the Section 2 second auxiliary filter 1122 has been replaced by a Section 2 second variable auxiliary filter 74 and a Section 2 learning second adaptive algorithm execution unit 84 that updates the transfer function $H_{22}(z)$ of the Section 2 second variable auxiliary filter 74 according to an FXLMS algorithm has been provided.

Also, the second learning block 60 is configured such that the first error signal $err_{h1}(n)$ output by the Section 1 error-correcting adder 1117 is output to the Section 1 learning first adaptive algorithm execution unit 81 and the Section 1 learning second adaptive algorithm execution unit 83 as error, while the second error signal $err_{h2}(n)$ output by the Section 2 error-correcting adder 1127 is output to the Section 2 learning first adaptive algorithm execution unit 82 and the Section 2 learning second adaptive algorithm execution unit 84 as error.

Additionally, the Section 1 learning first adaptive algorithm execution unit 81 updates the transfer function $H_{11}(z)$ of the Section 1 first variable auxiliary filter 71 according to a FXLMS algorithm such that the first error signal $err_{h1}(n)$ input as the error become zero (0). The Section 2 learning first adaptive algorithm execution unit 82 updates the transfer function $H_{12}(z)$ of the Section 2 first variable auxiliary filter 72 according to a FXLMS algorithm such that the second error signal $err_{h2}(n)$ input as the error becomes zero (0). The Section 1 learning second adaptive algorithm execution unit 83 updates the transfer function $H_{21}(z)$ of the Section 1 second variable auxiliary filter 73 according to a FXLMS algorithm such that the first error signal $err_{h1}(n)$ input as the error becomes zero (0). The Section 2 learning second adaptive algorithm execution unit 84 updates the transfer function $H_{22}(z)$ of the Section 2 second variable auxiliary filter 74 according to a FXLMS algorithm such that the second error signal $err_{h2}(n)$ input as the error becomes zero (0).

Next, in the second-stage learning process using such a second learning block 60, the first noise signal $x_1(n)$ and the second noise signal $x_2(n)$ are input into the first learning block 40, and if the transfer function $H_{11}(z)$ of the Section 1 first variable auxiliary filter 71, the transfer function $H_{12}(z)$ of the Section 2 first variable auxiliary filter 72, the $H_{21}(z)$ of the Section 1 second variable auxiliary filter 73, and the transfer function $H_{22}(z)$ of the Section 2 second variable auxiliary filter 74 have convergence and converge, each of the transfer functions $H_{11}(z)$, $H_{12}(z)$, $H_{21}(z)$, and $H_{22}(z)$ is acquired.

Herein, as illustrated in FIG. 6, provided that $P_{11}(z)$ is a transfer function of the first noise signal $x_1(n)$ to the output of the first microphone 12, $P_{12}(z)$ is a transfer function of the first noise signal $x_1(n)$ to the output of the second microphone 14, $P_{21}(Z)$ is a transfer function of the second noise signal $x_2(n)$ to the output of the first microphone 12, $P_{22}(z)$ is a transfer function of the second noise signal $x_2(n)$ to the output of the second microphone 14, $S_{P11}(z)$ is a transfer function of the first canceling signal CA1(n) to the output of the first microphone 12, $S_{P12}$ is a transfer function of the first canceling signal CA1(n) to the output of the second microphone 14, $S_{P21}$ is a transfer function of the second canceling signal CA2(n) to the output of the first microphone 12, $S_{P22}$ is a transfer function of the second canceling signal CA2(n) to the output of the second microphone 14, $err_{pi}(z)$ is the Z-transform of $err_{pi}(n)$, and $err_{hi}(z)$ is the Z-transform of $err_{hi}(n)$, $err_{p1}(z)$ output by the first microphone 12 becomes $$\begin{aligned} err_{p1}(z) &= x_1(z)P_{11}(z) + \{x_1(z)W_{11}(z) + x_2(z)W_{21}(x)\}S_{P11}(z) + \\ &\{x_1(z)W_{12}(z) + x_2(z)W_{22}(z)\}S_{P21}(z) + x_2(z)P_{21}(x) = \\ &x_1(z)\{P_{11}(z) + W_{11}(z)S_{P11}(z) + W_{12}(z)S_{P21}(z)\} + \\ &x_2(z)\{P_{21}(x) + W_{21}(x)S_{P11}(z) + W_{22}(z)S_{P21}(z)\} \end{aligned}$$

and $err_{p2}(z)$ output by the second microphone 14 similarly becomes $$\begin{aligned} err_{p2}(z) = {} & x_1(z)\{P_{12}(z)+W_{11}(z)S_{P12}(z)+W_{12}(z)S_{P22}(z)\}+ \\ & x_2(z)\{P_{22}(x)+W_{21}(x)S_{P12}(z)+W_{22}(z)S_{P22}(z)\}. \end{aligned}$$

Consequently, when the first error signal $err_{h1}(n)$ output by the Section 1 error-correcting adder 1117 becomes zero (0), $$\begin{aligned} err_{h1}(z) &= err_{p1}(z) + x_1(z)H_{11}(z) + x_2(z)H_{21}(z) = \\ &x_1(z)\{P_{11}(z) + W_{11}(z)S_{P11}(z) + W_{12}(z)S_{P21}(z)\} + \\ &x_2(z)\{P_{21}(x) + W_{21}(x)S_{P11}(z) + W_{22}(z)S_{P21}(z)\} + \\ &x_1(z)H_{11}(z) + x_2(z)H_{21}(z) = 0. \end{aligned}$$

Further, similarly, when the second error signal $err_{h2}(n)$ becomes zero (0), $$\begin{aligned} err_{h2}(z) &= err_{p2}(z) + x_1(z)H_{12}(z) + x_2(z)H_{22}(z) = \\ &x_1(z)\{P_{12}(z) + W_{11}(z)S_{P12}(z) + W_{12}(z)S_{P22}(z)\} + \\ &x_2(z)\{P_{22}(x) + W_{21}(x)S_{P12}(z) + W_{22}(z)S_{P22}(z)\} + \\ &x_1(z)H_{12}(z) + x_2(z)H_{22}(z) = 0. \end{aligned}$$

Consequently, because $x_1(z)\neq 0$ and $x_2(z)\neq 0$, $err_{h1}(z)=0$ and $err_{h2}(z)=0$ hold when $$H_{11}(z)=-\{P_{11}(z)+W_{11}(z)S_{P11}(z)+W_{12}(z)S_{P21}(z)\}$$

$$H_{12}(z)=-\{P_{12}(z)+W_{11}(z)S_{P12}(z)+W_{12}(z)S_{P22}(z)\}$$

$$H_{21}(z)=-\{P_{21}(x)+W_{21}(x)S_{P11}(z)+W_{22}(z)S_{P21}(z)\}$$

$$H_{22}(z)=-\{P_{22}(x)+W_{21}(x)S_{P12}(z)+W_{22}(z)S_{P22}(z)\},$$

substituting the above into the transfer functions $W_{11}(z)$, $W_{12}(z)$, $W_{21}(z)$, and $W_{22}(z)$ acquired by the first learning process and set in the Section 1 first fixed filter 61, the Section 2 first fixed filter 62, the Section 1 second fixed filter 63, and the Section 2 second fixed filter 64 gives $$\begin{aligned} H_{11}(z)=-[&P_{11}(z)+\{V_{12}(z)S_{V21}(z)-V_{11}(z)S_{V22}(z)\} \\ &S_{P11}(z)+\{V_{11}(z)S_{V12}(z)-V_{12}(z)S_{V11}(z)\}S_{P21}(z)]/ \\ &[S_{V11}(z)S_{V22}(z)-S_{V12}(z)S_{V21}(z)] \end{aligned}$$

$$\begin{aligned} H_{12}(z)=-[&P_{12}(z)+\{V_{12}(z)S_{V21}(z)-V_{11}(z)S_{V22}(z)\} \\ &S_{P12}(z)+\{V_{11}(z)S_{V12}(z)-V_{12}(z)S_{V11}(z)\}S_{P22}(z)]/ \\ &[S_{V11}(z)S_{V22}(z)-S_{V12}(z)S_{V21}(z)] \end{aligned}$$

$$\begin{aligned} H_{21}(z)=-[&P_{21}(x)+\{V_{22}(z)S_{V21}(z)-V_{21}(z)S_{V22}(z)\} \\ &S_{P11}(z)+\{V_{21}(z)S_{V12}(z)-V_{22}(z)S_{V11}(z)\}S_{P21}(z)]/ \\ &[S_{V11}(z)S_{V22}(z)-S_{V12}(z)S_{V21}(z)] \end{aligned}$$

$$\begin{aligned} H_{22}(z)=-[&P_{22}(x)+\{V_{22}(z)S_{V21}(z)-V_{21}(z)S_{V22}(z)\} \\ &S_{P12}(z)+\{V_{21}(z)S_{V12}(z)-V_{22}(z)S_{V11}(z)\}S_{P22}(z)]/ \\ &[S_{V11}(z)S_{V22}(z)-S_{V12}(z)S_{V21}(z)]. \end{aligned}$$

In the second learning block 60, the transfer functions $H_{11}(z)$, $H_{12}(z)$, $H_{21}(z)$, and $H_{22}(z)$ converge on these values.

Next, if such transfer functions $H_{11}(z)$, $H_{12}(z)$, $H_{21}(z)$, and $H_{22}(z)$ converged by the second-stage learning process using the second learning block 60 are acquired, the second-stage learning process ends.

At this point, the transfer functions $H_{11}(z)$ and $H_{21}(z)$ acquired in this way correct the difference in the transfer functions of each of the noise signals $x_1(n)$ and $x_2(n)$ and each of the canceling signals CA1(n) and CA2(n) to the first cancellation point and the position of the first microphone 12, while the transfer functions $H_{12}(z)$ and $H_{22}(z)$ acquired in this way correct the difference in the transfer functions of each of the noise signals $x_1(n)$ and $x_2(n)$ and each of the canceling signals CA1(n) and CA2(n) to the second cancellation point and the position of the second microphone 14.

Subsequently, the transfer function $H_{11}(z)$ of the Section 1 first variable auxiliary filter 71 acquired by the second-stage learning process in this way is set as the transfer function of the Section 1 first auxiliary filter 1111 of the signal processing block 11 in FIG. 3, the acquired transfer function $H_{12}(z)$ of the Section 2 first variable auxiliary filter 72 is set as the transfer function of the Section 2 first auxiliary filter 1112 of the signal processing block 11 in FIG. 3, the acquired transfer function $H_{21}(z)$ of the Section 1 second variable auxiliary filter 73 is set as the transfer function of the Section 1 second auxiliary filter 1121 of the signal processing block 11 in FIG. 3, the acquired transfer function $H_{22}(z)$ of the Section 2 second variable auxiliary filter 74 is set as the transfer function of the Section 2 second auxiliary filter 1122 of the signal processing block 11 in FIG. 3, and the learning process ends.

The above describes the learning process in the signal processing block 11 that sets the transfer function $H_{11}(z)$ of the Section 1 first auxiliary filter 1111, the transfer function $H_{12}(z)$ of the Section 2 first auxiliary filter 1112, the transfer function $H_{21}(z)$ of the Section 1 second auxiliary filter 1121, and the transfer function $H_{22}(z)$ of the Section 2 second auxiliary filter 1122.

In this way, in the signal processing block 11 of FIG. 3 in which $H_{11}(z)$, $H_{12}(z)$, $H_{21}(z)$, and $H_{22}(z)$ are set, similarly to the second learning block 60, the first error signal $err_{h1}(n)$ output by the Section 1 error-correcting adder 1117 becomes $$err_{h1}(z)=err_{p1}(z)+x_1(z)H_{11}(z)+x_2(z)H_{21}(z),$$

and the second error signal $err_{h2}(n)$ becomes $$err_{h2}(z)=err_{p2}(z)+x_1(z)H_{12}(z)+x_2(z)H_{22}(z).$$

At this point, $H_{11}(z)$, $H_{12}(z)$, $H_{21}(z)$, and $H_{22}(z)$ are the values learned according to the second-stage learning process using the second learning block 60 such that $err_{h1}(z)$ and $err_{h2}(z)$ become zero (0) when the transfer functions $W_{11}$, $W_{12}$, $W_{21}$, and $W_{22}$ are the values acquired by the first-stage learning process using the first learning block 40. Consequently, in the same standard acoustic environment as the first-stage learning process and the second-stage learning process, by updating the transfer functions $W_{11}$, $W_{12}$, $W_{21}$, and $W_{22}$ of the Section 1 first variable filter 1113, the Section 2 first variable filter 1115, the Section 1 second variable filter 1123, and the Section 2 second variable filter 1125 in the signal processing block 11 such that $err_{h1}(z)$ and $err_{h2}(z)$ become zero (0), the transfer functions $W_{11}$, $W_{12}$, $W_{21}$, and $W_{22}$ of the Section 1 first variable filter 1113, the Section 2 first variable filter 1115, the Section 1 second variable filter 1123, and the Section 2 second variable filter 1125 converge on the values acquired by the first-stage learning process using the first learning block 40.

In other words, when the transfer functions $W_{11}$, $W_{12}$, $W_{21}$, and $W_{22}$ of the Section 1 first variable filter 1113, the Section 2 first variable filter 1115, the Section 1 second variable filter 1123, and the Section 2 second variable filter 1125 are the values acquired by the first-stage learning process using the first learning block 40, because, as described earlier, $$H_{11}(z) = -\{P_{11}(z) + W_{11}(z)S_{P11}(z) + W_{12}(z)S_{P21}(z)\}$$

$$H_{12}(z) = -\{P_{12}(z) + W_{11}(z)S_{P12}(z) + W_{12}(z)S_{P22}(z)\}$$

$$H_{21}(z) = -\{P_{21}(x) + W_{21}(x)S_{P11}(z) + W_{22}(z)S_{P21}(z)\}$$

$$H_{22}(z) = -\{P_{22}(x) + W_{21}(x)S_{P12}(z) + W_{22}(z)S_{P22}(z)\}$$

hold true, $$\begin{aligned} err_{h1}(z) = err_{p1}(z) + x_1(z)H_{11}(z) + x_2(z)H_{21}(z) = \\ x_1(z)\{P_{11}(z) + W_{11}(z)S_{P11}(z) + W_{12}(z)S_{P12}(z)\} + \\ x_2(z)\{P_{21}(x) + W_{21}(x)S_{P11}(z) + W_{22}(z)S_{P21}(z)\} - \\ x_1(z)\{P_{11}(z) + W_{11}(z)S_{P11}(z) + W_{12}(z)S_{P21}(z)\} - \\ x_2(z)\{P_{21}(x) + W_{21}(x)S_{P11}(z) + W_{22}(z)S_{P21}(z)\} = 0 \end{aligned}$$

and $$\begin{aligned} err_{h2}(z) = err_{p2}(z) + x_1(z)H_{12}(z) + x_2(z)H_{22}(z) = \\ x_1(z)\{P_{12}(z) + W_{11}(z)S_{P12}(z) + W_{12}(z)S_{P22}(z)\} + \\ x_2(z)\{P_{22}(x) + W_{21}(x)S_{P12}(z) + W_{22}(z)S_{P22}(z)\} - \\ x_1(z)\{P_{12}(z) + W_{11}(z)S_{P12}(z) + W_{12}(z)S_{P22}(z)\} - \\ x_2(z)\{P_{22}(x) + W_{21}(x)S_{P12}(z) + W_{22}(z)S_{P22}(z)\} = 0 \end{aligned}$$

hold.

Additionally, the transfer functions $W_{11}$, $W_{12}$, $W_{21}$, and $W_{22}$ acquired by the first-stage learning process using the first learning block 40 are values that cancel the noise produced by the first noise source 21 and the noise produced by the second noise source 22 at the first cancellation point and the second cancellation point. Consequently, in the same standard acoustic environment as the acoustic environment in which the first-stage learning process and the second-stage learning process are performed, the active noise control system 1 provided with the signal processing block 11 of FIG. 3 is capable of canceling the noise produced by the first noise source 21 and the noise produced by the second noise source 22 at the first cancellation point and the second cancellation point away from the first microphone 12 and the second microphone 14.

Also, with respect to variations of the acoustic environment from the same acoustic environment as the first-stage learning process and the second-stage learning process, by updating the transfer functions $W_{11}$, $W_{12}$, $W_{21}$, and $W_{22}$ of the Section 1 first variable filter 1113, the Section 2 first variable filter 1115, the Section 1 second variable filter 1123, and the Section 2 second variable filter 1125 according to the MEFX LMS of the transfer functions $W_{11}$, $W_{12}$, $W_{21}$, and $W_{22}$ such that the first error signal $err_{h1}(n)$ and the second error signal $err_{h2}(n)$ become 0, the noise produced by the first noise source 21 and the noise produced by the second noise source 22 may be canceled adaptively at the first cancellation point and the second cancellation point.

The foregoing describes embodiments and implementations of the present disclosure.

Note that embodiments and implementations may be configured such that the functions for performing the learning process described above are included in the signal processing block 11, and the learning process is executed in the signal processing block 11.

Also, in the foregoing embodiments and implementations, the first noise signal $x_1(n)$ and the second noise signal $x_2(n)$ that are input into the active noise control system 1 may be sound signals from separately-provided noise microphones that pick up the noise from each noise source, or signals that simulate the noise from each noise source generated by separately-provided sound simulation devices.

In other words, for example, in the case of treating the engine as the first noise source 21, engine noise picked up by a separate noise microphone may be taken to be the first noise signal $x_1(n)$, or simulated sound that simulates engine noise generated by a separately-provided sound simulation device may be taken to be the first noise signal $x_1(n)$.

Also, the active noise control system 1 according to the foregoing embodiments and implementations may be applied by expanding the configuration to canceling noise from three or more noise sources.

It is intended that the foregoing detailed description be regarded as illustrative rather than limiting, and that it be understood that it is the following claims, including all equivalents, that are intended to define the spirit and scope of this disclosure.

What is claimed is:

1. An active noise control system that reduces noise, comprising:

a plurality of subsystems, where each subsystem is respectively provided in correspondence with a noise cancellation position of a plurality of noise cancellation positions, wherein each subsystem of the plurality of subsystems includes a microphone and a speaker disposed near a corresponding noise cancellation position of the plurality of noise cancellation positions, a canceling sound-generating adder, an error-computing adder, a plurality of adaptive filters, where each adaptive filter of the plurality of adaptive filters is respectively provided in correspondence with a noise of a plurality of noises, that accept the corresponding noise as input, and a plurality of auxiliary filters, where each auxiliary filter of the plurality of auxiliary filters is respectively provided in correspondence with a noise of the plurality of noises, that accept the corresponding noise as input, wherein the canceling sound-generating adder of each subsystem of the plurality of subsystems adds together outputs from the plurality of adaptive filters of the subsystem, and outputs a result to the speaker of the subsystem, wherein the error-computing adder of each subsystem of the plurality of subsystems adds together and outputs an output from the microphone of the subsystem and outputs from the plurality of auxiliary filters of the subsystem, wherein an adaptive filter of the plurality of adaptive filters of each subsystem updates a transfer function of that adaptive filter of the plurality of adaptive filters by executing a predetermined adaptive algorithm that treats the output from the error-computing adder of each subsystem as an error, and wherein a transfer function is set in each auxiliary filter of the plurality of auxiliary filters such that the error computed by the error-computing adder of each subsystem becomes zero (0) when each adaptive filter of the plurality of adaptive filters of the subsystem sets a transfer function in which each noise of the plurality of noises is canceled at each cancellation position in a predetermined standard acoustic environment.

2. An active noise control system that reduces noise, comprising:

two subsystems respectively provided in correspondence with each of two noise cancellation positions, wherein each subsystem includes a microphone and a speaker disposed near the corresponding noise cancellation position, a canceling sound-generating adder, an error-computing adder, two adaptive filters, respectively provided in correspondence with each of two noises, that accept the corresponding noise as input, and two auxiliary filters, respectively provided in correspondence with each of the two noises, that accept the corresponding noise as input, wherein the canceling sound-generating adder of each subsystem adds together outputs from the two adaptive filters of the subsystem, and outputs a result to the speaker of the subsystem, wherein the error-computing adder of each subsystem adds together and outputs an output from the microphone of the subsystem and the outputs from the two auxiliary filters of the subsystem, wherein an adaptive filter of each subsystem updates a transfer function of that adaptive filter by executing a predetermined adaptive algorithm that treats the output from the error-computing adder of each subsystem as an error, and wherein provided that $P_{jk}$ is the transfer function of the jth noise to the output from the microphone of the kth subsystem, $S_{Pjk}$ is the transfer function from the speaker of the jth subsystem to the output from the microphone of the kth subsystem, $V_{jk}$ is the transfer function of the jth noise to the kth cancellation position, $S_{Vjk}$ is the transfer function from the speaker of the jth subsystem to the kth cancellation position, and $H_{jk}$ is the transfer function of the auxiliary filter corresponding to the jth noise of the kth subsystem, $$H_{11}(z) = -[P_{11}(z) + \{V_{12}(z)S_{V21}(z) - V_{11}(z)S_{V22}(z)\}S_{P11}(z) + \{V_{11}(z)S_{V12}(z) - V_{12}(z)S_{V11}(z)\}S_{P21}(z)] / [S_{V11}(z)S_{V22}(z) - S_{V12}(z)S_{V21}(z)]$$

$$H_{12}(z) = -[P_{12}(z) + \{V_{12}(z)S_{V21}(z) - V_{11}(z)S_{V22}(z)\}S_{P12}(z) + \{V_{11}(z)S_{V12}(z) - V_{12}(z)S_{V11}(z)\}S_{P22}(z)] / [S_{V11}(z)S_{V22}(z) - S_{V12}(z)S_{V21}(z)]$$

$$H_{21}(z) = -[P_{21}(x) + \{V_{22}(z)S_{V21}(z) - V_{21}(z)S_{V22}(z)\}S_{P11}(z) + \{V_{21}(z)S_{V12}(z) - V_{22}(z)S_{V11}(z)\}S_{P21}(z)] / [S_{V11}(z)S_{V22}(z) - S_{V12}(z)S_{V21}(z)]$$

$$H_{22}(z) = -[P_{22}(x) + \{V_{22}(z)S_{V21}(z) - V_{21}(z)S_{V22}(z)\}S_{P12}(z) + \{V_{21}(z)S_{V12}(z) - V_{22}(z)S_{V11}(z)\}S_{P22}(z)] / [S_{V11}(z)S_{V22}(z) - S_{V12}(z)S_{V21}(z)].$$

3. An audio system onboard an automobile provided with the active noise control system according to claim 2, comprising:

an audio device for a user seated in a first seat of the automobile, that emits audio inside the automobile, wherein the two noises are left-channel audio and right-channel audio emitted by the audio device, and wherein the two noise cancellation positions are a position of a left ear and a position of a right ear of a user seated in a second seat of the automobile.

4. A setting method of an active noise control system that reduces noise, the active noise control system including:

two subsystems respectively provided in correspondence with each of two noise cancellation positions, wherein each subsystem includes a microphone and a speaker disposed near the corresponding noise cancellation position, a canceling sound-generating adder, an error-computing adder, two adaptive filters, respectively provided in correspondence with each of two noises, that accept the corresponding noise as input, and two auxiliary filters, respectively provided in correspondence with each of the two noises, that accept the corresponding noise as input, wherein the canceling sound-generating adder of each subsystem adds together outputs from the two adaptive filters of the subsystem, and outputs a result to the speaker of the subsystem, wherein the error-computing adder of each subsystem adds together and outputs an output from the microphone of the subsystem and the outputs from the two auxiliary filters of the subsystem, wherein an adaptive filter of each subsystem is configured to update a transfer function of that adaptive filter by executing a predetermined adaptive algorithm that treats the output from the error-computing adder of each subsystem as error, and wherein the setting method is a method of setting a transfer function of each auxiliary filter, comprising:

executing a first step of learning a transfer function of each adaptive filter that converges in a configuration obtained by respectively disposing two setting microphones at each of two noise cancellation positions, and changing a configuration of the active noise control system such that each adaptive filter executes a predetermined adaptive algorithm treating an output from each setting microphone as an error to update the transfer function of that adaptive filter, and executing a second step of learning a transfer function, of each adaptive filter that is replacing each auxiliary filter, as the transfer function to set in the auxiliary filter replaced by the adaptive filter that converges in a configuration of the active noise control system obtained by fixing the transfer function of each adaptive filter to the transfer function learned in the first step and replacing each auxiliary filter with an adaptive filter that treats the output from the error-computing adder of the same subsystem as the subsystem of the auxiliary filter as an error to execute a predetermined adaptive algorithm and update the transfer function of the adaptive filter.

* * * * *